US006205420B1

(12) United States Patent
Takagi et al.

(10) Patent No.: US 6,205,420 B1
(45) Date of Patent: Mar. 20, 2001

(54) METHOD AND DEVICE FOR INSTANTLY CHANGING THE SPEED OF A SPEECH

(75) Inventors: Tohru Takagi; Nobumasa Seiyama; Atsushi Imai; Akio Ando, all of Tokyo (JP)

(73) Assignee: Nippon Hoso Kyokai, Tokyo (JP)

( * ) Notice: Subject to any disclaimer, the term of this patent is extended or adjusted under 35 U.S.C. 154(b) by 0 days.

(21) Appl. No.: 09/180,429

(22) PCT Filed: Mar. 13, 1998

(86) PCT No.: PCT/JP98/01063

§ 371 Date: Nov. 6, 1998

§ 102(e) Date: Nov. 6, 1998

(87) PCT Pub. No.: WO98/41976

PCT Pub. Date: Sep. 24, 1998

(30) Foreign Application Priority Data

Mar. 19, 1997 (JP) ..... 9-061015

(51) Int. Cl.[7] ..... G10L 21/00; G10L 21/02; G10L 21/04

(52) U.S. Cl. ..... 704/211; 704/200; 704/266; 704/267; 704/258

(58) Field of Search ..... 704/200, 211, 704/201, 267, 258, 271, 278, 266

(56) References Cited

U.S. PATENT DOCUMENTS

| | | | | |
|---|---|---|---|---|
| 5,073,938 | * | 12/1991 | Galand | 704/207 |
| 5,305,420 | * | 4/1994 | Nakamura et al. | 704/271 |
| 6,009,386 | * | 1/2000 | Cruikshank et al. | 704/207 |

FOREIGN PATENT DOCUMENTS

| | | |
|---|---|---|
| 0 527 527 | 2/1993 | (EP) . |
| 1-93795 | 4/1989 | (JP) . |
| 3-123397 | 5/1991 | (JP) . |
| 6-202691 | 7/1994 | (JP) . |
| 6-222794 | 8/1994 | (JP) . |
| 7191695 | 7/1995 | (JP) . |
| 8-83095 | 3/1996 | (JP) . |
| 9-152889 | 6/1997 | (JP) . |

* cited by examiner

*Primary Examiner*—Richemond Dorvil
*Assistant Examiner*—Daniel A. Nolan
(74) *Attorney, Agent, or Firm*—Olson & Hierl, Ltd.

(57) ABSTRACT

An analysis processor applies an analysis process to input speech data thereby to obtain block lengths for respective attributes of voiced sound, voiceless sound and silence. A block data splitter splits the input speech data into blocks having the block lengths dependent on the respective attributes. A block data memory sequentially stores speech data split by the block data splitter as block speech data and the block lengths. A connection data generator generates connection data for connecting the adjacent block speech data each other at every moment by using the block speech data. A connection data storing portion sequentially stores the connection data. A connection order generator generates block connection order of the block speech data and the connection data at every moment according to at least the block lengths output sequentially from the block data storing portion and extension scaling factors in time for the respective attributes. A speech data connector connects sequentially the block speech data and the connection data based on the block connection order. Accordingly, the speed of output speech can be instantly changed in response to an instruction of an operator.

5 Claims, 3 Drawing Sheets

METHOD AND DEVICE FOR INSTANTLY CHANGING THE SPEED OF A SPEECH

TECHNICAL FIELD

The present invention relates to a speech speed converting method and a device for embodying the same which are employed in various video devices, audio devices, medical devices, etc. such as a television set, a radio, a tape recorder, a video tape recorder, a video diskplayer, etc. and, more particularly, aspeech speed converting method and a device for embodying the same which is able to provide speed-converted speech whose speech speed is fitted for a listening capability of a listener by processing a speech of a speaker.

BACKGROUND ART

In general, for example, in the case that one person (listener) listens to the speech of the other person (speaker), when the listening capability, e.g., a speech recognition critical speed (maximum speech speed at which the speech can be precisely identified) of the listener is declined because of aging or any disorder, it becomes often hard for the listener to identify the speech with an ordinary speed or the speech of rapid talking. In such case, normally the listener can make up for the listening capability by using a so-called hearing aid.

However, the conventional hearing aid which is used by the person having declined listening capability or hearing disorder can simply make up for propagation characteristics of an external ear and a middle ear in an auditory organ by virtue of an improvement of a frequency characteristic, a gain control, etc. Therefore, there has been such a problem that decline of the speech identification capability which is mainly associated with degradation of an auditory center cannot be compensated.

In light of the above, recently a speech speed controlled type hearing aiding device has been thought out which can aid the hearing by processing the speech of the speaker such that the speech speed can be adjusted for the listening capability of the listener in substantially real time.

According to this speech speed controlled type hearing aiding device, by executing an expansion process for expanding the speech of the speaker in time, and then storing sequentially the speech obtained by the expansion process into an output buffer memory, and then outputting stored speech, the speech speed of the speaker is changed (slowed down) to compensate the decline of the listening capability of the listener.

However, in the above speech speed controlled type hearing aid in the prior art, there have been problems described in the following.

To begin with, the speech speed controlled type hearing aid in the prior art expands the speech data input as described above by the expansion process, then stores sequentially the speech data obtained by the expansion process into the output buffer memory, and then outputs the stored speech data. Therefore, for example, in case the listener wishes to slow down the speech speed much more or restore the speech speed into the original speed in the middle of listening, the speech speed cannot be restored into the original speed until all the speech data which are stored in the output buffer memory have been output.

For this reason, there has been a problem that, in order to restore the speech speed in the middle of listening, a considerably long delay in time is caused until the existing speech speed can be restored into the original speed.

In addition, such speech speed controlled type hearing aid in the prior art can be employed by not only the above listener who has the declined listening capability but also the listener who has the normal listening capability but wish to listen to the foreign language, for example, in the application field to change (slow down) the speech speed of the speaker in order to compensate their listening capability. However, in this case, there has been a problem that, like the above, a time delay is caused upon changing the speech speed in the middle of listening.

The present invention has been made in light of the above circumstances, and it is an object of the present invention to provide a speech speed converting method and a device for embodying the same which is able to convert the speech speed of the output voice to follow instantly an operation of the listener, and thus to improve extremely the convenience of use on the listener side.

DISCLOSURE OF THE INVENTION

In order to achieve the above object, according to one aspect of the present invention, there is provided a method for instantly changing the speed of speech, comprising the steps of applying an analysis process to input speech data thereby to obtain block lengths for respective attributes of voiced sound, voiceless sound and silence; splitting the input speech data having a voiced sound section, a voiceless sound section and a silent section into blocks having the block lengths dependent on the respective attributes; storing the split speech data as block speech data and the block lengths sequentially in a buffer and outputting the block speech data and the block lengths sequentially from the buffer; generating connection data at every moment, which are to be replaced or inserted between adjacent block speech data to connect the adjacent block speech data to each other, every block, and then storing the connection data sequentially in another buffer and outputting the connection data sequentially from the other buffer; generating block connection order of the block speech data and the connection data at every moment according to at least the block lengths output sequentially from the buffer and extension scaling factors in time for the respective attributes; and connecting sequentially the block speech data output from the buffer and the connection data output from the other buffer according to the block connection order to thus generate output speech data extended in time as compared with the input speech data.

Accordingly, the speech speed of the output voice can be converted to follow instantly an operation of the listener, and thus the convenience of use on the listener side can be improved extremely.

In a preferred embodiment of the present invention, the connection data are generated block by block by applying two windows to speech data located at a start portion of a concerned block and speech data located at a start portion of a succeeding block respectively, and then overlapadding the start portion of the succeeding block to the start portion of the concerned block, each window having the shape of a predetermined line in a predetermined time interval.

In order to achieve the above object, according to another aspect of the present invention, there is provided a device for instantly changing the speed of speech comprising an analysis processor for applying an analysis process to input speech data thereby to obtain block lengths for respective attributes of voiced sound, voiceless sound and silence; a block data splitter for splitting the input speech data having a voiced sound section, a voiceless sound section and a silent section into blocks having the block lengths dependent on the respective attributes; a block data storing portion for sequentially storing speech data split by the block data splitter as block speech data and the block lengths; a connection data generator for generating connection data at every moment, which are able to be replaced or inserted between adjacent block speech data to connect the adjacent block data each other, by using the block speech data obtained by the block data splitter; a connection data storing portion for sequentially storing the connection data being generated by the connection data generator; a connection order generator for generating block connection order of the block speech data and the connection data at every moment according to at least the block lengths output sequentially from the block data storing portion and extension scaling factors in time for the respective attributes; and a speech data connector for connecting sequentially the block speech data output from the block data storing portion and the connection data output from the connection data storing portion based on the block connection order obtained by the block connection order generator to thus generate output speech data extended in time as compared with the input speech data.

In a preferred embodiment of the present invention, the connection data generator generates the connection data block by block by applying two windows to speech data located at a start portion of a concerned block and speech data located at a start portion of a succeeding block respectively, and then overlap-adding the start portion of the succeeding block to the start portion of the concerned block, each window having the shape of a predetermined line in a predetermined time interval.

In a preferred embodiment of the present invention, the connection order generator includes a read/write memory for storing the extension scaling factors in time for the respective attributes, and a connection order deciding processor for reading the extension scaling factors in time for the respective attributes stored in the read/write memory at a predetermined time interval, and generating the block connection order of the block speech data and the connection data at every moment based on the extension scaling factors, the block lengths output from the block data storing portion, and the already-connected information output from the speech data connector.

Accordingly, the speech speed of the output voice can be converted to follow momentarily an operation of the listener, and thus the convenience of use on the listener side can be improved extremely.

BEST MODE FOR CARRYING OUT THE INVENTION

Figure 1:
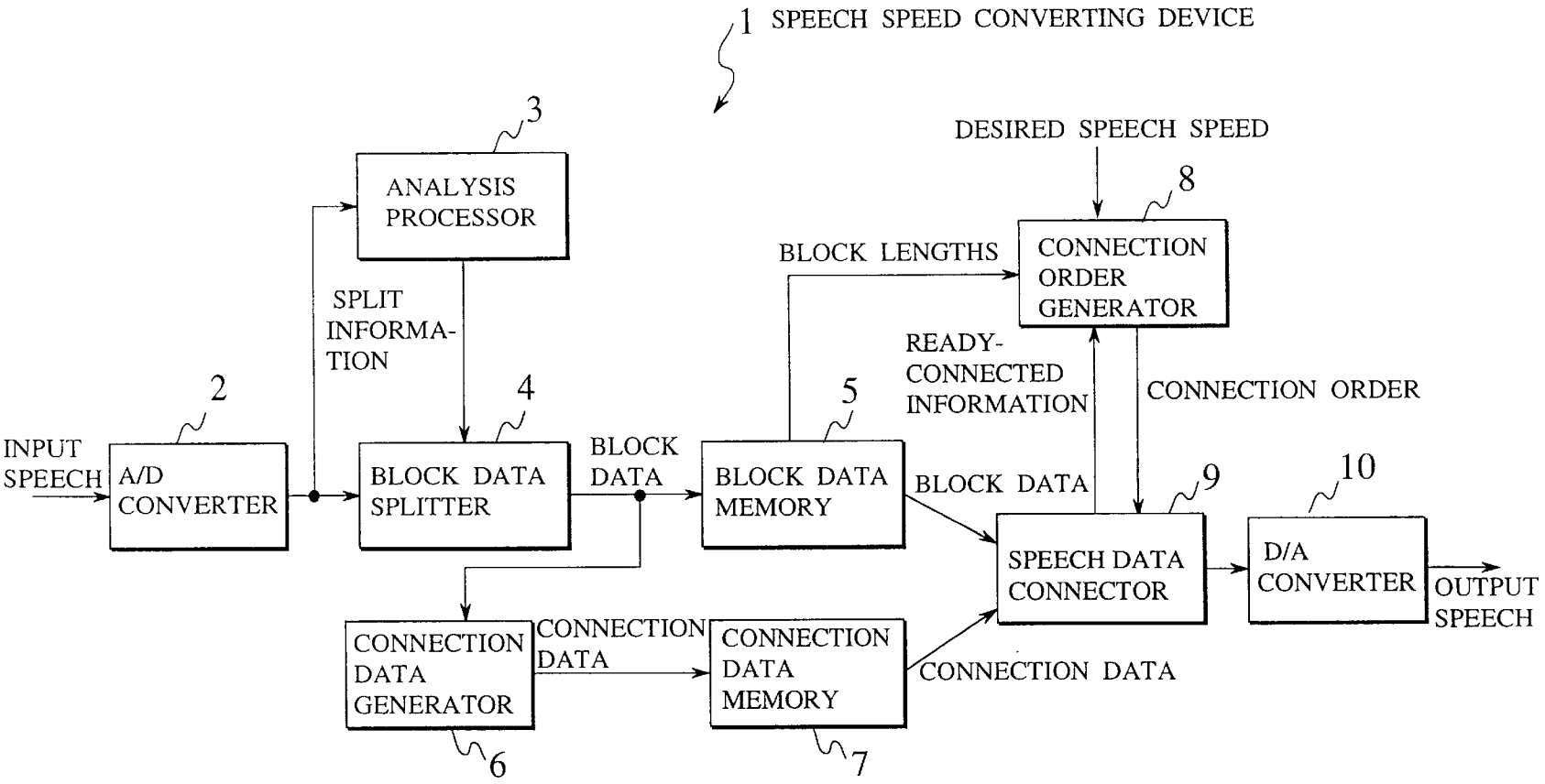
FIG. 1 is a block diagram showing an example of a speech speed converting method according to the present invention and a speech speed converting device as an embodiment.

FIG. 1 is a block diagram showing an embodiment of a speech speed converting device according to the present invention.

A speech speed converting device 1 shown in this figure comprises an A/D converter 2 for converting an input speech signal into a digital speech data, an analysis processor 3 for analyzing attributes of the speech data, a block data splitter 4 for splitting the speech data into block data to generate block speech data, a block data memory 5 for storing the block speech data, a connection data generator 6 for generating connection data necessary for connecting the block speech data, a connection data memory 7 for storing the connection data, a connection order generator 8 for generating connection order of the block speech data and the connection data, a speech data connector 9 for generating a series of speech data by connecting the block speech data and the connection data based on the connection order, and a D/A converter 10 for converting a series of speech data into speech signals.

Then, the speech speed converting device 1 applies analyzing process to the speech data being input by the speaker based on the attributes, then splits the speech data in unit of block having a predetermined time width according to analyzed information derived by the analyzing process, and then stores block data. Also, in order to achieve expansion of the speech data in time, the speech speed converting device 1 generates the speech data to be replaced or inserted between the adjacent block speech data every block, and then stores the speech data. Then, the speech speed converting device 1 generates the block connection order to generate the output speech data corresponding to any voice speed in response to the operation of the listener, and then connects sequentially the speech data (block speech data), which have already been split in unit of block and stored, and to-be-replaced/inserted speech data (connection data), which have already been stored, according to the connection order to generate the output speech data. As a result, the speech speed of the output voice can follow instantly in response to an operation of the listener.

The A/D converter 2 comprises an A/D converter circuit for A/D-converting an input speech signal into a digital speech data by sampling the input speech signal at a predetermined sampling rate (e.g., 32 kHz), and a FIFO memory for receiving the digital speech data output from the A/D converter circuit to store therein and then outputting them in the FIFO fashion. The A/D converter 2 receives the speech signal being input into an input terminal on the speaker side, e.g., the speech signal being output from an analogue sound output terminal of the video device, the audio device, etc. such as a microphone, a television, a radio, etc., then A/D-converts the speech signal into the digital speech data, and then supplies resultant speech data to the analysis processor 3 and the block data splitter 4 while buffering the speech data.

The analysis processor 3 executes sequentially an input process for receiving the speech data being output from the A/D converter 2; a decimation(thinning) process for reducing a deal of succeeding process by lowering the sampling rate of the speech data obtained the input process to 4 kHz; an attribute analysis process for analyzing attributes of the speech data being output from the A/D converter 2 and the speech data obtained by the above decimation process to divide the speech data into voiced sound, voiceless sound, and silent; and a block length decision process for detecting periodicity of the voiced sound, the voiceless sound, and the silent by executing their autocorrelation analysis and then deciding block lengths required to divide the speech data (block lengths required to prevent disadvantages such as change in voice tone, e.g., low voice, due to the repetition of block unit) based on detected results. The analysis processor 3 then supplies resultant split information (block lengths of the voiced sound, the voiceless sound, and the silent) to the block data splitter 4.

In this case, in the above attribute analysis process, a sum of squares of the speech data being output from the A/D converter 2 is calculated by using a window width of about 30 ms, and also power values P of the speech data are calculated at an interval of about 5 ms. Also, the power values P and a previously set threshold value $P_{min}$ are compared with each other, and as a result a data area to satisfy "$P<P_{min}$" is decided as a silent interval and also a data area to satisfy "$P_{min} \leqq P$" is decided as a voiced sound interval and a voiceless interval. Then, zero crossing analysis of the speech data output from the A/D converter 2, autocorrelation analysis of the speech data obtained by the above decimation process, etc. are carried out. Based on these analysis results and the power values P, it is decided whether the data area of the speech data which satisfies "$P_{min} \leqq P$" belongs to the voice interval with vibration of the vocal cords (voiced sound interval) or the voice interval without vibration of the vocal cords (voiceless sound interval). In this case, attributes such as the noise or the background sound like the music may be considered as attributes of the speech data being output from the A/D converter 2. However, since in general it is hard to automatically discriminate the speech signals precisely from signals of the noise and the background sound, the noise and the background sound are classified into any one of the voiced sound, the voiceless sound, and the silent.

Also, the above block length decide process applies the autocorrelation analyses having different long/short window widths to the speech data, which have been decided as the voiced sound interval by the attribute analysis process, over a wide range of 1.25 ms to 28.0 ms, in which pitch periods of the voiced sound are distributed, then detects the pitch periods (pitch periods which are vibration periods of the vocal cords) as precisely as possible, then decides block lengths based on detection results such that respective pitch periods correspond to respective block lengths. Meanwhile, the above block length decide process applies detects periodicity of less than 10 ms from the speech data in the intervals which have been decided as the voiceless sound interval and the silent interval by the attribute analysis process, and then decides the block lengths based on detected results. As a result, respective block lengths of the voiced sound, the voiceless sound, and the silent are supplied as split information to the block data splitter 4.

The block data splitter 4 splits the speech data being output from the A/D converter 2 based on the block length of the voiced sound interval, the voiceless sound interval, and the silent interval which are indicated by the split information being output from the analysis processor 3. Then, the block data splitter 4 supplies the speech data (block speech data) get by this split process in block unit and the block lengths of the speech data to both the block data memory 5 and the connection data generator 6.

The block data memory 5 is equipped with a ring buffer. The block data memory 5 receives the block speech data (speech data in block unit) and the block lengths of the speech data output from the block data splitter 4, then stores temporarily them in the ring buffer, then reads appropriately respective block lengths being stored temporarily, and then supplies the block lengths to the connection order generator 8. Also, the block data memory 5 reads appropriately the block speech data being stored temporarily and then supplies such block speech data to the speech data connector 9.

Figure 2:
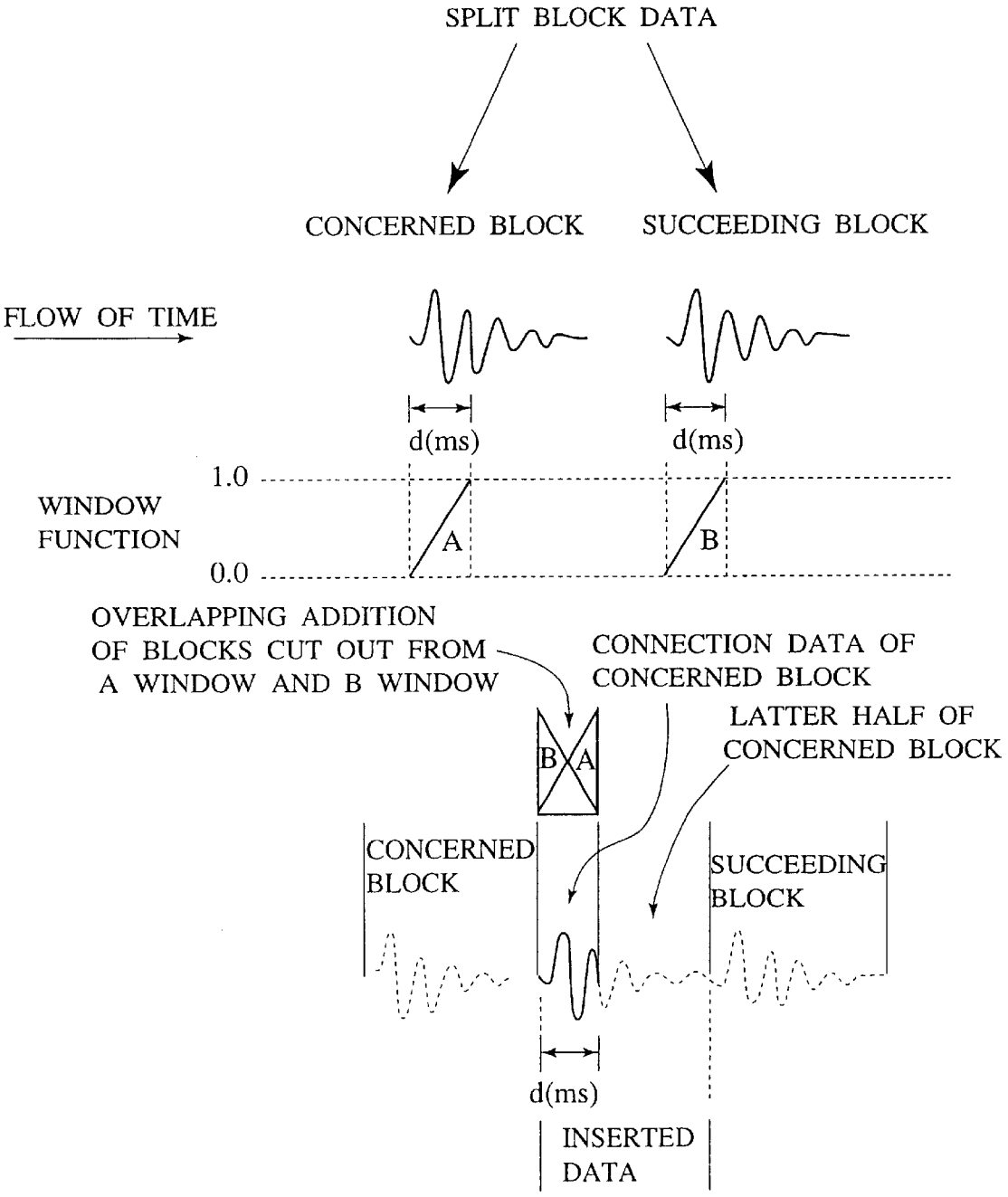
FIG. 2 is a schematic view showing an example of connection data generating steps executed in a connection data generator shown in FIG. 1.

Then, the connection data generator 6 receives the block speech data being output from the block data splitter 4, then applies a window every block to the speech data located at a start portion of a concerned block and the speech data located at a start portion of a succeeding block by using an A window and a B window, which are changed linearly in a time interval d (ms), as shown in FIG. 2, then adds overlappedly the start portion of the succeeding block to the start portion of the concerned block to generate the connection data of the time interval d (ms), and then supplies such connection data to the connection data memory 7. A value of [0.5 (ms)] to [the shortest one of the block lengths of the concerned block and the succeeding block] can be selected as the time interval d, but the shortest one of the block lengths can provide a smaller capacity of the buffer in the connection data memory 7.

The connection data memory 7 has a ring buffer, and receives the connection data being output from the connection data generator 6, then stores temporarily the connection data in the ring buffer, then reads appropriately the connection data being stored temporarily, and then supplies the connection data to the speech data connector 9.

The connection order generator 8 includes a writable memory for storing expansion magnifications of respective attributes in time, which are input by operating a digital setting means such as a digital volume by the listener; and a connection order deciding processor for reading the expansion magnifications of respective attributes in time stored in the writable memory at a predetermined time interval being set previously, e.g., at a time interval of about 100 ms, and generating the connection order (connection order required to implement the desired speech speed being set by the listener) of the speech data in unit of block and the connection data in unit of block every moment based on these expansion magnifications, respective block lengths output from the block data storing portion 5, and the ready-connected information which are output from the speech data connector 9.

Figure 3:
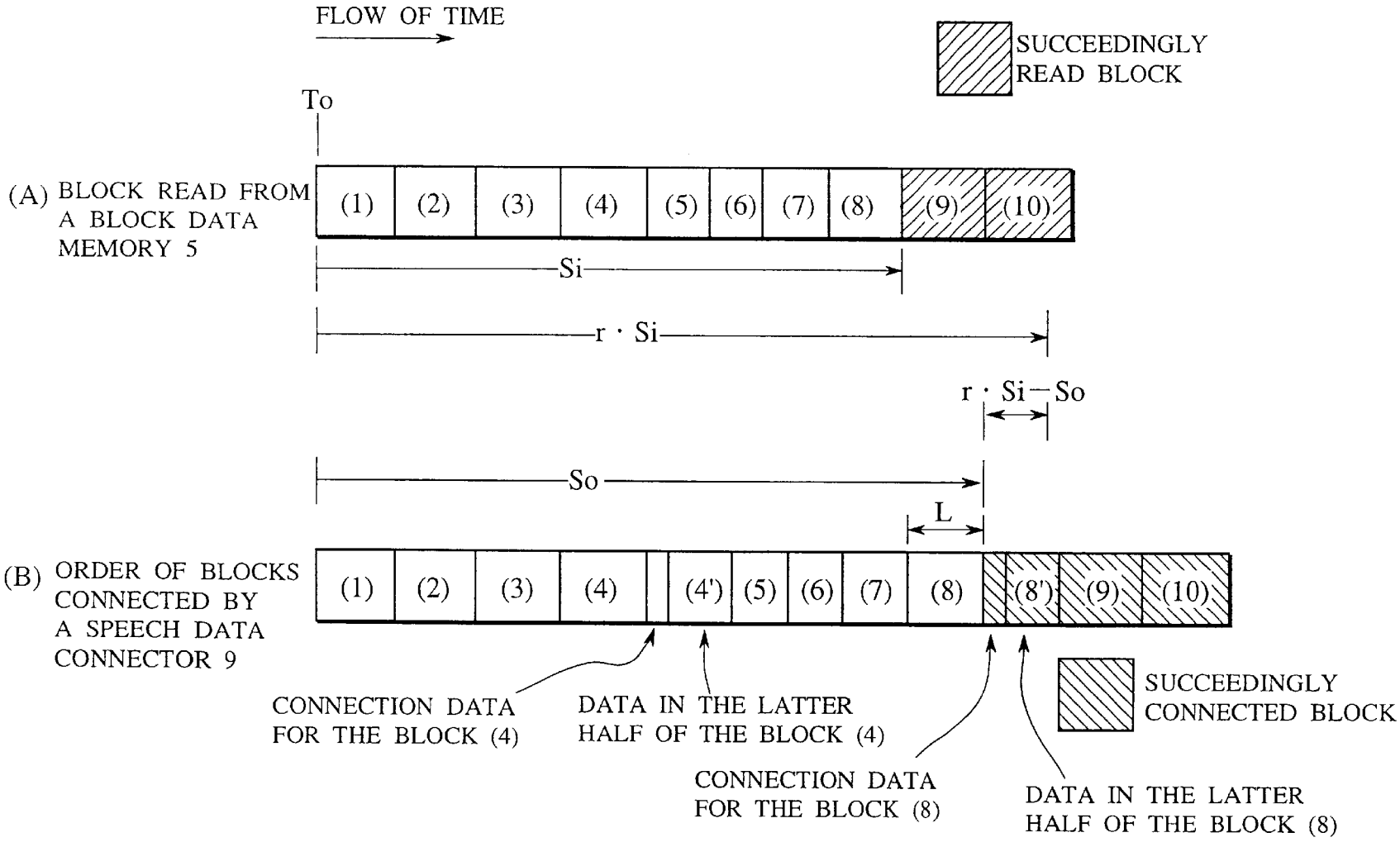
FIG. 3 is a schematic view showing an example of connection order generating steps executed in a connection order generator shown in FIG. 1.

Then, in the situation that the speech signals in which the voiced sound interval, the voiceless sound interval, and the silent interval sequentially alternately appear are being input, when switching of the attributes of the block speech data can be detected by the ready-connected information being output from the speech data connector 9 as shown in FIG. 3, or when it can be detected that the expansion magnifications of the block speech data being read from the writable memory have been changed even if the block speech data having the same attribute are still connected, it is decided that a starting condition of generating the connection order has been ready. A time at the moment is decided as a time $T_0$.

Then, the connection data, which correspond to the finally connected block, out of the connection data being output from the connection data memory 7 are replaced/inserted at a timing to satisfy a condition given by $$L/2<r\cdot S_i-S_o \quad [1]$$

where "$S_i$" is a total sum of all the block lengths of the block speech data from a start time $T_0$ which have already been output from the block data memory 5 to the speech data connector 9 before the speech speed is changed, "$S_o$" is a total sum of all the block lengths of the block speech data from the start time $T_0$ which have already been connected, "r" (where $r \geqq 1.0$) is a target expansion magnification, and "L" is the block length of the block speech data which have been connected lastly. Then, a part of the lastly connected block, which is located after a part of the block employed in generation of the connection data, is repeatedly connected again, then the connection order indicating that remaining blocks are connected sequentially after this block is generated and then supplied to the speech data connector 9.

Accordingly, in an example shown in FIG. 3, since the condition given by Eq.[1] can be satisfied at the time point when the block (1) to the block (8) have been connected sequentially, the connection data corresponding to the block (8) are replaced/inserted after the block (8), and then a part, which is located after the part of the block (8) employed in generation of the connection data, is repeatedly connected. In the example shown in FIG. 3, the block (4) has already connected repeatedly once.

The speech data connector 9 supplies connected contents such as the block speech data, which have already been connected, as the ready-connected information to the connection order generator 8. At the same time, based on the connection order output from the connection order generator 8, the speech data connector 9 connects the block speech data being output from the block data memory 5 and the connection data being output from the connection data memory 7 to thus generate a series of speech data. Then, the speech data connector 9 supplies a series of resultant speech data to the D/A converter 10 while buffering them.

The D/A converter 10 includes a memory for storing the speech data and then outputting the speech data in the FIFO manner, and a D/A converting circuit for reading the speech data from the memory at a predetermined sampling rate (e.g., 32 kHz) and then A/D-converting the speech data into speech signals. The D/A converter 10 receives a series of speech data being output from the speech data connector 9, then D/A-converts the speech data into the speech signals, and then outputs resultant speech signals from an output terminal.

In this manner, in the present embodiment, the output voice can be created based on speech speed conversion controlling information indicating any speech speed in response to the operation of the listener, while controlling the order of the block speech data stored previously and the connection data. Therefore, the voice can be output promptly at the desired speech speed even when the listener changes the speech speed by the manual operation, so that it is possible for the listener not to feel the time delay when the speech speed is changed in the middle.

As a result, only by applying the speech speed converting device 1 according to the present invention to various video devices, audio devices, medical devices, etc. such as the television set, the radio, the tape recorder, the video tape recorder, the video disk player, etc., the speed speech of the output voice can be changed instantly in response to the operation of the listener when the speech speed is fitted for the listening capability of the listener by processing the speech of the speaker.

In the above embodiment, the windows have been applied to the starting portions of respective block speech data by using the A window and the B window, which are changed linearly as shown in FIG. 2, in the connection data generator 6. However, the windows may be applied to the starting portions of respective block speech data by using windows which have a cosine curve respectively. In addition, if a buffer capacity of the connection data memory 7 is sufficiently large, the window may be applied to not only the starting portions of respective block speech data but also the full block length.

Moreover, in the above embodiment, as shown in FIG. 3, the connection data of the block speech data (4), (8) and the latter half of the block speech data (4), (8) are repeated only once in the connection order generator 8. But, if the expansion magnification "r" satisfies "r>2", the same block speech data may be repeated twice or more.

INDUSTRIAL APPLICATION

As described above, according to the present invention, the speech speed of the output voice can be converted to follow instantly an operation of the listener, and thus the convenience of use on the listener side can be improved extremely.

What is claimed is:

1. A method for instantly changing the speed of speech, comprising the steps of:

applying an analysis process to input speech data thereby to obtain block lengths for respective attributes of voiced sound, voiceless sound and silence;

splitting the input speech data having a voiced sound section, a voiceless sound section and a silent section into blocks having the block lengths dependent on the respective attributes;

storing the split speech data as block speech data and the block lengths sequentially in a buffer and outputting the block speech data and the block lengths sequentially from the buffer;

generating connection data at every moment, which are to be replaced or inserted between adjacent block speech data to connect the adjacent block speech data each other, every block, and then storing the connection data sequentially in another buffer and outputting the connection data sequentially from the other buffer;

generating block connection order of the block speech data and the connection data at every moment according to at least the block lengths output sequentially from the buffer and extension scaling factors in time for the respective attributes; and connection sequentially the block speech data output from the buffer and the connection data output from the other buffer according to the block connection order to thus generate output speech data extended in time as compared with the input speech data.

2. A method for instantly changing the speed of speech according to claim 1, wherein the connection data are generated block by block by applying two windows to speech data located at a start portion of a concerned block and speech data located at a start portion of a succeeding block respectively, and then overlap-adding the start portion of the succeeding block to the start portion of the concerned block, each window having the shape of a predetermined line in a predetermined time interval.

3. A device for instantly changing the speed of speech, comprising:

an analysis processor for applying an analysis process to input speech data thereby to obtain block lengths for respective attributes of voiced sound, voiceless sound and silence;

a block data splitter for splitting the input speech data having a voiced sound section, a voiceless sound section and a silent section into blocks having the block lengths dependent on the respective attributes;

a block data storing portion for sequentially storing speech data split by the block data splitter as block speech data and the block lengths;

a connection data generator for generating connection data at every moment, which are able to be replaced or inserted between adjacent block speech data to connect the adjacent block speech data each other, by using the block speech data obtained by the block data splitter;

a connection data storing portion for sequentially storing the connection data being generated by the connection data generator;

a connection order generator for generating block connection order of the block speech data and the connection data at every moment according to at least the block lengths output sequentially from the block data storing portion and extension scaling factors in time for the respective attributes; and a speech data connector for connecting sequentially the block speech data output from the block data storing portion and the connection data output from the connection data storing portion based on the block connection order obtained by the block connection order generator to thus generate output speech data extended in time as compared with the input speech data.

4. A device for instantly changing the speed of speech according to claim 3, wherein the connection data generator generates the connection data block by block by applying two windows to speech data located at a start portion of a concerned block and speech data located at a start portion of a succeeding block respectively, and then overlap-adding the start portion of the succeeding block to the start portion of the concerned block, each window having the shape of a predetermined line in a predetermined time interval.

5. A device for instantly changing the speed of speech according to claim 3, wherein the connection order generator includes, a read/write memory for storing the extension scaling factors in time for the respective attributes, and a connection order deciding processor for reading the the extension scaling factors in time for the respective attributes stored in the read/write memory at a predetermined time interval, and generating the block connection order of the block speech data and the connection data at every moment based on the extension scaling factors, the block lengths output from the block data storing portion, and the already-connected information output from the speech data connector.

* * * * *